US007294008B2

(12) United States Patent
Fukuyama

(10) Patent No.: US 7,294,008 B2
(45) Date of Patent: Nov. 13, 2007

(54) WATERPROOF LEAD AND METHOD FOR MAKING THE SAME

(75) Inventor: Shozo Fukuyama, Ibaraki (JP)

(73) Assignee: Tyco Electronics Raychem K.K., Kanagawa-ken (JP)

( * ) Notice: Subject to any disclaimer, the term of this patent is extended or adjusted under 35 U.S.C. 154(b) by 0 days.

(21) Appl. No.: 10/972,137

(22) Filed: Oct. 22, 2004

(65) Prior Publication Data

US 2005/0095892 A1 May 5, 2005

(30) Foreign Application Priority Data

Oct. 31, 2003 (JP) ..... 2003-373068

(51) Int. Cl.
*H01R 25/00* (2006.01)

(52) U.S. Cl. ..... 439/287

(58) Field of Classification Search ..... 439/287, 439/587, 589, 271–276, 284, 291–292, 342
See application file for complete search history.

(56) References Cited

U.S. PATENT DOCUMENTS

| | | | | |
|---|---|---|---|---|
| 3,601,783 | A | 8/1971 | Loose | |
| 5,310,350 | A | 5/1994 | Matsuoka et al. | 439/72 |
| 6,095,859 | A * | 8/2000 | Maeda | 439/587 |
| 6,191,480 | B1 | 2/2001 | Kastberg et al. | 257/727 |
| 6,402,551 | B1 * | 6/2002 | Ozaki | 439/578 |
| 6,443,765 | B2 * | 9/2002 | Ichio et al. | 439/587 |
| 6,449,157 | B1 | 9/2002 | Chu | 361/704 |

FOREIGN PATENT DOCUMENTS

| | | |
|---|---|---|
| EP | 0 938 159 A1 | 8/1999 |
| JP | 10-289745 | 10/1998 |
| JP | 2000-182688 | 6/2000 |
| JP | 2000-285983 | 10/2000 |
| JP | 2001-110464 | 4/2001 |

OTHER PUBLICATIONS

European Search Report for Application No. EP 04 10 5146 dated Nov. 23, 2004.
Search Report and Written Opinion of Singapore dated Nov. 30, 2004 for Application No. 200306245-2.

* cited by examiner

*Primary Examiner*—J. F. Duverne
(74) *Attorney, Agent, or Firm*—Barley Snyder LLC

(57) ABSTRACT

A waterproof lead includes an electric wire, a terminal, and a heat-shrink tube. The electric wire has an insulative cover and a plurality of exposed core wires. The terminal has a contact member, a core wire crimping section that crimps the plurality of exposed core wires, and an insulative cover crimping section that crimps the insulative cover. The heat-shrink tube covers at least a leading end of the exposed core wires adjacent to the core wire crimping section. An adhesive is provided on an internal surface of the heat-shrink tube. The adhesive seals clearances between adjacent exposed core wires.

19 Claims, 7 Drawing Sheets

WATERPROOF LEAD AND METHOD FOR MAKING THE SAME

FIELD OF THE INVENTION

The invention relates to a waterproof lead consisting of a terminal, an electric wire, and a heat-shrink tube that covers a leading end of exposed core wires of the electric wire. The invention further relates to a method and a jig for making the same.

BACKGROUND OF THE INVENTION

In order to connect a terminal having a contact member, a core wire crimping section and an insulative cover crimping section to an electric wire, the electric wire is stripped of an insulative cover at an end thereof to expose core wires. The exposed core wires are crimped with the core wire crimping section, and the leading end of the remaining insulative cover is crimped with the cover crimping section. If the terminal connected to the electric wire (referred to as a lead, hereinafter) is used at a place where intrusion of water, such as rainwater, is likely to occur, measures for protecting the lead from water have to be taken.

In one example of a conventional waterproof lead (Japanese Patent Laid-Open No. 2001-110464), an end portion of the core wires are crimped with the core wire crimping section, soldered, and a trailing end of the crimped portion of the core wires is covered with a shrinkable tube. A tubular terminal surrounds the portion of the core wires crimped with the core wire crimping section to shield the core wires from water intrusion. The manufacture of this conventional waterproof lead requires attaching the shrinkable tube and soldering. Because two steps are required, workability is poor and manufacturing costs are high. Furthermore, the tubular terminal is not easy to fabricate, which also raises manufacturing costs.

In another example of a conventional waterproof lead (Japanese Patent Laid-Open No. 2000-285983 and Japanese Patent Laid-Open No. 2000-182688), the core wires that are crimped with the core wire crimping section are covered with a heat-shrink tube that has an adhesive applied to an internal surface thereof. The heat-shrink tube is heated to melt the adhesive. The molten adhesive coats an outer circumference of the bundle of core wires. Since water intrusion into the electric wire often occurs at the leading end of the core wires through clearances between adjacent core wires, coating only the circumference of the bundle of core wires does not adequately waterproof the lead.

SUMMARY OF THE INVENTION

It is therefore an object of the invention to provide a waterproof lead and a method and jig for manufacturing the same wherein sufficient measures for waterproofing are performed at a low cost.

This and other objects are achieved by a waterproof lead comprising an electric wire, a terminal, and a heat-shrink tube. The electric wire has an insulative cover and a plurality of exposed core wires. The terminal has a contact member, a core wire crimping section that crimps the plurality of exposed core wires, and an insulative cover crimping section that crimps the insulative cover. The heat-shrink tube covers at least a leading end of the exposed core wires adjacent to the core wire crimping section. An adhesive is provided on an internal surface of the heat-shrink tube. The adhesive seals clearances between adjacent exposed core wires.

This and other objects are further achieved by a method for making a waterproof lead wherein a portion of an insulative cover is stripped from an electric wire to expose a plurality of core wires. The plurality of core wires is crimped with a core wire crimping section of a terminal. The insulative cover is crimped with a cover crimping section of the terminal. At least a leading end of the plurality of core wires adjacent to the core wire crimping section is covered after crimping with a heat-shrink tube that has an adhesive provided on an internal surface thereof. The adhesive is melted to seal clearances between adjacent core wires with the adhesive.

This and other objects are still further achieved by a jig for making a waterproof lead that has a terminal, an electric wire, and a heat-shrink tube covering at least a leading end of exposed core wires of the electric wire. The jig comprises upper and lower grip members for receiving the waterproof lead therebetween. The upper grip member has a stopper for positioning between the leading ends of the exposed core wires and a contact member of the terminal for preventing an adhesive on the internal surface of the heat-shrink tube from reaching the contact member.

DETAILED DESCRIPTION OF THE INVENTION

Figure 1:
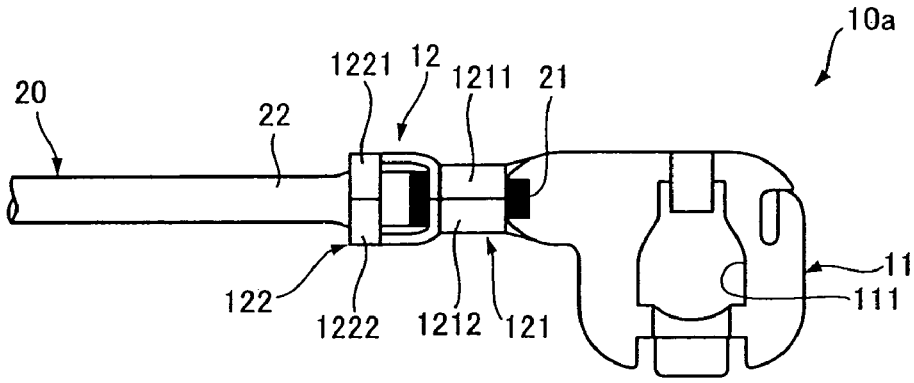
FIG. 1 is a plan view of a first terminal.
Figure 2:
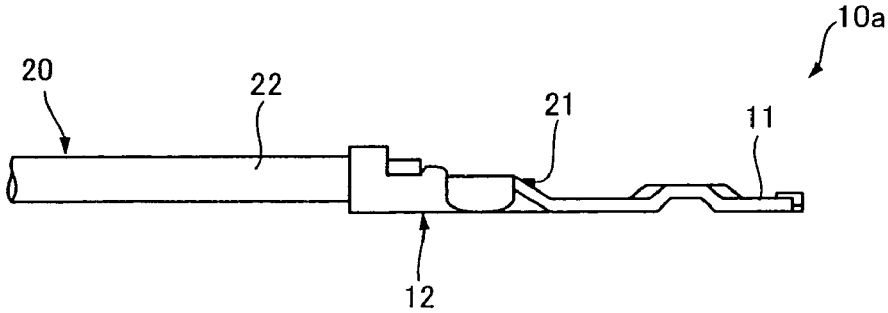
FIG. 2 is a side view of the first terminal shown in FIG. 1.
Figure 3:
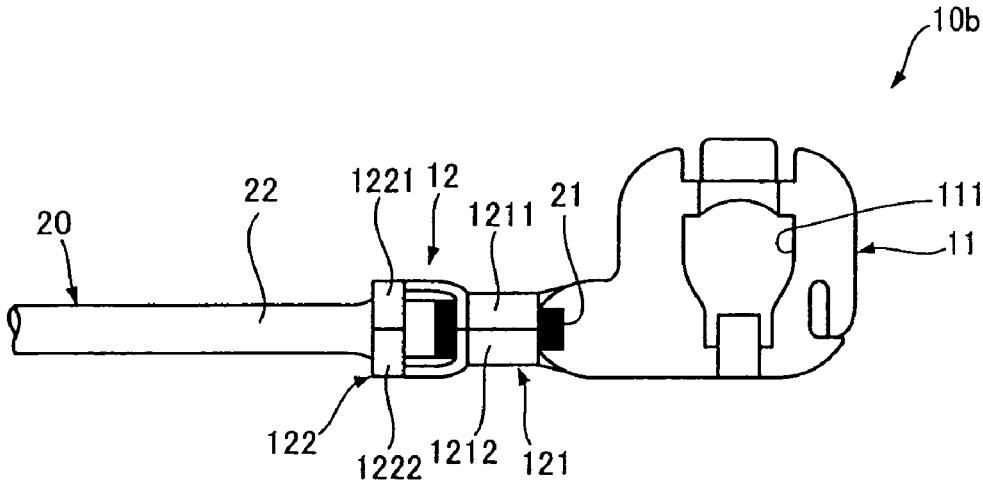
FIG. 3 is a plan view of a second terminal.
Figure 4:
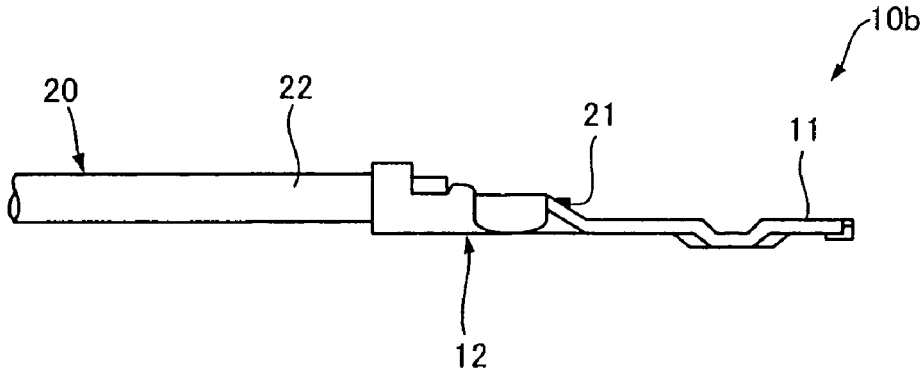
FIG. 4 is a side view of the second terminal shown in FIG. 3.

FIGS. 1–2 show a first terminal 10*a*, and FIGS. 3–4 show a second terminal 10*b*. The first and second terminals 10*a*, 10*b* may be, for example, connected to a battery or the like in an engine room of an automobile. The first and second terminals 10*a*, 10*b* each have a contact member 11 and a wire attachment member 12. The contact member 11 has an insertion opening 111 for receiving a bolt (not shown). The contact member 11 may be a male contact member, such as a ring contact member and a tab contact member, or a female contact member, such as a receptacle contact member. The wire attachment member 12 is arranged at a rear end of the contact member 11 and has a core wire crimping section 121 and an insulative cover crimping section 122. The core wire crimping section 121 consists of a pair of crimping members 1211, 1212 that extend from both sides of a front portion of the wire attachment member 12. The insulative cover crimping section 122 consists of a pair of crimping arms 1221, 1222 that extend from both sides of a rear portion of the wire attachment member 12.

As shown in FIGS. 1–4, the first and second terminals 10*a*, 10*b* are each connected to an electric wire 20. The electric wire 20 has an insulative cover 22 containing core wires 21. The pair of crimping members 1211, 1212 crimp the core wires 21 that are exposed after stripping the insulative cover 22 from a leading end of the electric wire 20. The pair of crimping arms 1221, 1222 crimp a leading end of the insulative cover 22 that remains on the electric wire 20 after the insulative cover 22 is stripped from the leading end of the electric wire 20. Leading ends of the core wires 21 extend from the core wire crimping section 121 toward the contact member 11.

Figure 5:
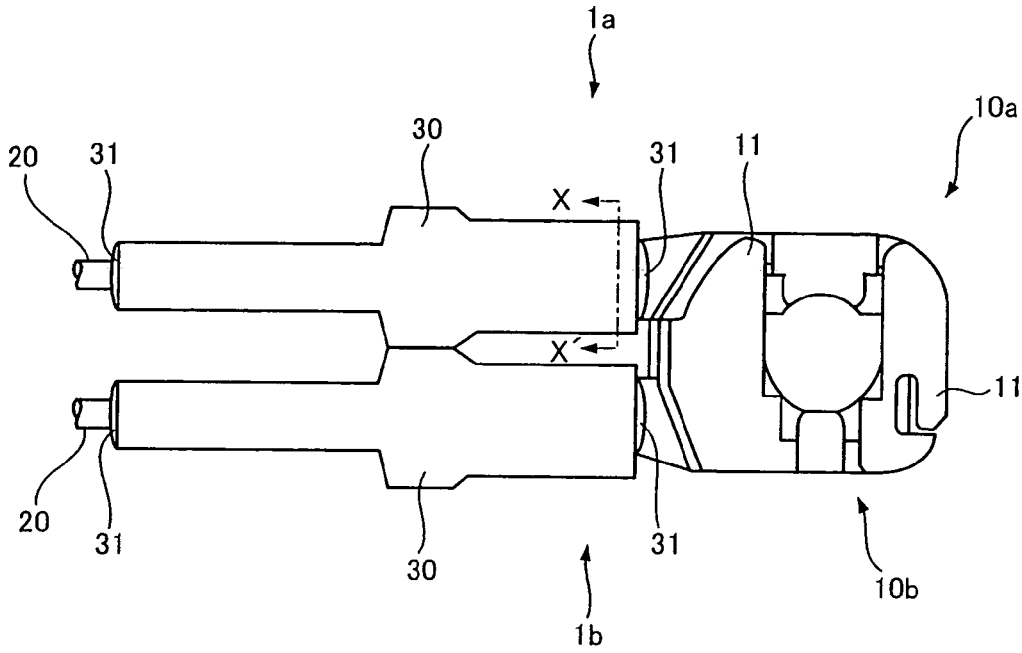
FIG. 5 is a schematic view of the first terminal mated with the second terminal.

FIG. 5 shows the contact member 11 of the first terminal 10*a* mated with the contact member 11 of the second terminal 10*b*. The core wire crimping section 121 and the insulative cover crimping section 122 of the first and second terminals 10*a*, 10*b* are covered with a heat-shrink tube 30. A hot-melt adhesive 31 is applied to an internal surface of the heat-shrink tube 30. The adhesive 31 may be integral with the heat-shrink tube 30 or separate therefrom. As the heat-shrink tube 30 is heated, the adhesive 31 on the internal surface of the heat-shrink tube melts and a portion of the adhesive 31 flows from the internal surface of the heat-shrink tube 30 toward ends thereof where it is set.

The first terminal 10*a*, the electric wire 20 having the core wires 21 crimped with the core wire crimping section 121, the insulative cover 22 crimped with the insulative cover crimping section 122, and the heat-shrink tube 30 covering the core wire crimping section 121 after crimping of the electric wire 20 thereto form a first waterproof lead 1*a*. The second terminal 10*b*, the electric wire 2*c* having the core wires 21 crimped with the core wire crimping section 121, the insulative cover 22 crimped with the insulative cover crimping section 122, and the heat-shrink tube 30 covering the core wire crimping section 121 after crimping of the electric wire 20 thereto form a second waterproof lead 1*b*.

Figure 6:
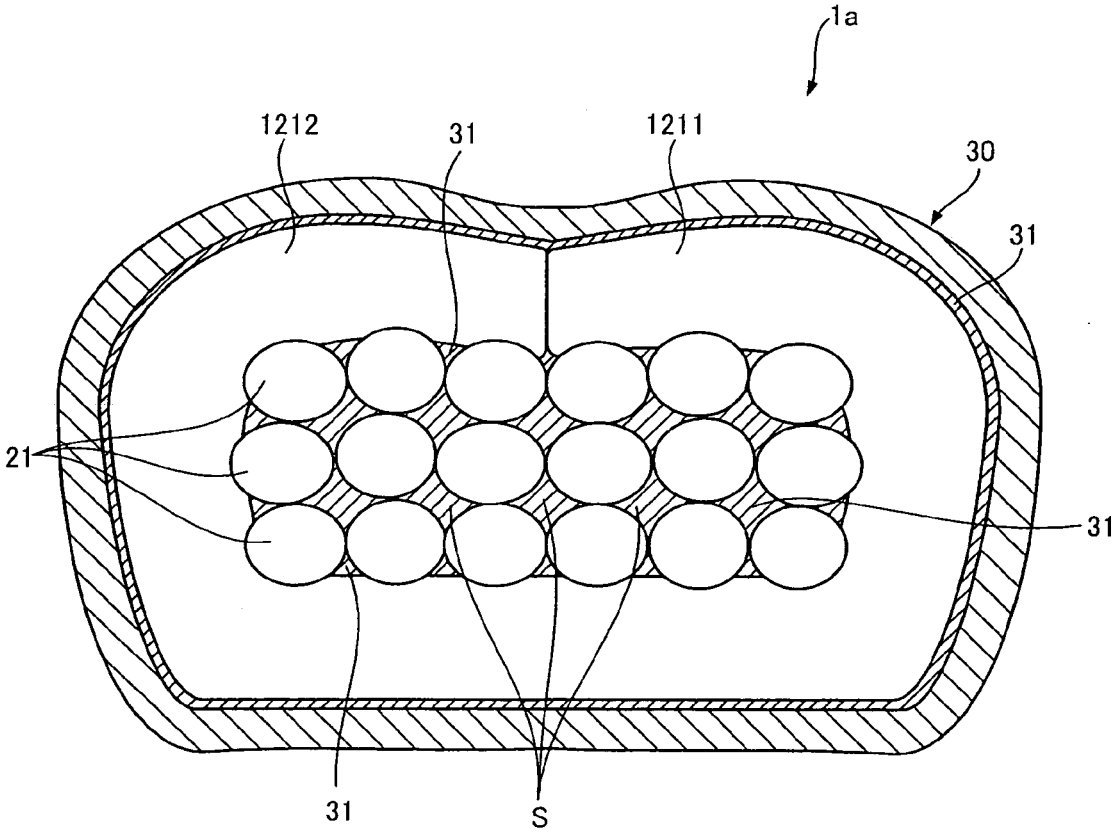
FIG. 6 is a schematic cross-sectional view of a waterproof lead taken along line X—X of FIG. 5.

FIG. 6 shows a lateral cross section of the leading ends of the core wires 21 of the first waterproof lead 1*a* shown in FIG. 5. As shown in FIG. 6, the heat-shrink tube 30 forms an outermost layer of the first waterproof lead 1*a* shown in FIG. 6. The heat-shrink tube 30 shrinks when heated in a radial direction to adhere to the paired crimping members 1211, 1212 of the core wire crimping section 121. The adhesive 31 on the internal surface of the heat-shrink tube 30 flows into clearances S between the adjacent core wires 21 that protrude from the core wire crimping section 121 such that the clearances S are sealed with the adhesive 31. If the clearances S were not sealed, the electric wire 20 would be vulnerable to water intrusion.

Figure 8:
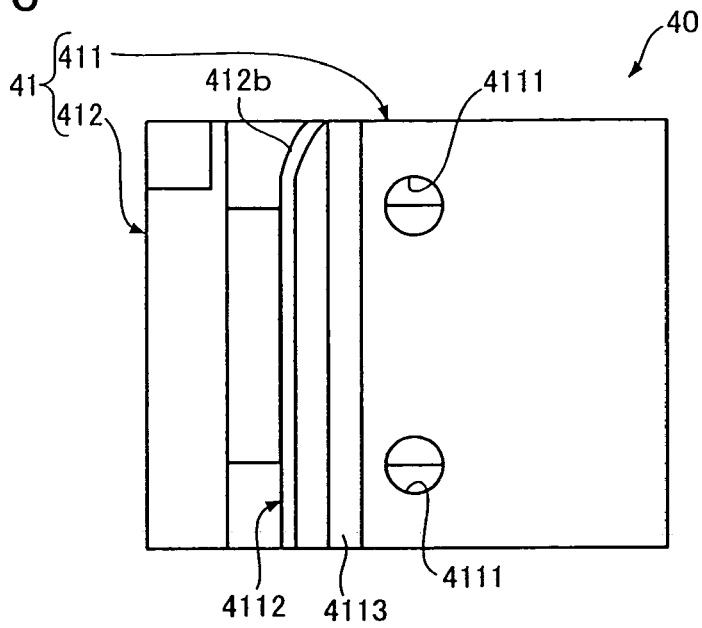
FIG. 8 is a plan view of a jig.
Figure 9:
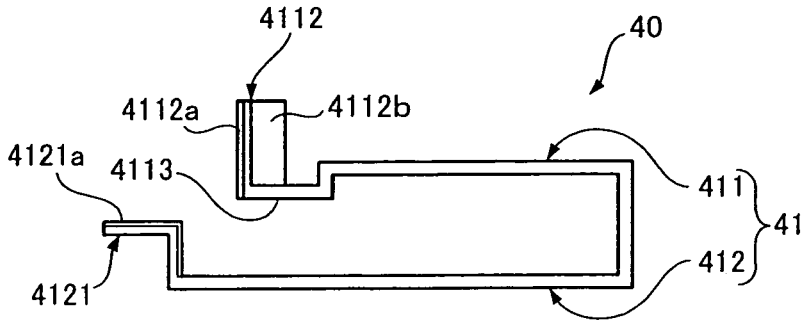
FIG. 9 is a side view of the jig shown in FIG. 8.
Figure 10:
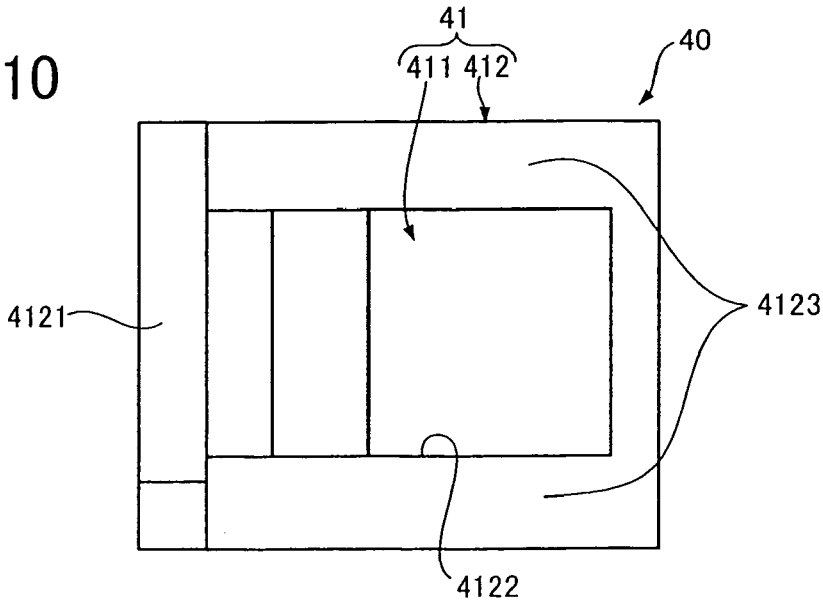
FIG. 10 is a bottom view of the jig shown in FIG. 8.

FIGS. 8–10 show a jig 40 used to make the first and second waterproof leads 1*a*, 1*b*. The jig 40 is formed from a single metal plate and is die cut and bent to have a pair of grip members 41. The pair of grip members 41 includes an upper grip member 411 and a lower grip member 412. As shown in FIG. 9, one end of each of the upper and lower grip members 411, 412 is a free end and the other ends of the upper and lower grip members 411, 412 are connected. The pair of grip members 41 grip the waterproof leads 1*a*, 1*b* shown in FIG. 5 from a top and a bottom thereof.

As shown in FIG. 8, the upper grip member 411 has two through-holes 4111. Bolts (not shown) are inserted into the through-holes 4111 for attaching a jig handle 50 (FIG. 11) to the jig 40. As shown in FIG. 9, the free end of the upper grip member 411 is bent upward approximately 90 degrees to form a stopper 4112. The stopper 4112 is formed along the entire width of the jig 40 (vertical direction in FIG. 8) and has a coating 4112*a* of tetrafluoroethylene resin thereon. The upper grip member 411 has a recess 4113 formed toward the lower grip member 412 and between the through-holes 4111 and the stopper 4112 along the entire width of the jig 40. To facilitate insertion of the first and second waterproof leads 1*a*, 1*b*, a lateral end of the stopper 4112 is curved rearward to form an introduction section 4112*b*.

As shown in FIG. 10, the lower grip member 412 has a cut-out 4122 in a middle thereof. As shown in FIG. 9, the free end of the lower grip member 412 is bent approximately 90 degrees toward the upper grip member 411 and toward a front of the jig 40 to form a tube pressing section 4121 with a substantially L-shaped profile. The tube pressing section 4121 is formed along the entire width of the jig 40 and has a coating 4121*a* of tetrafluoroethylene resin thereon. As shown in FIG. 10, lateral ends of the tube pressing section 4121 are connected to a pair of arm sections 4123 extending from sides of the cut-out 4122.

Figure 7:
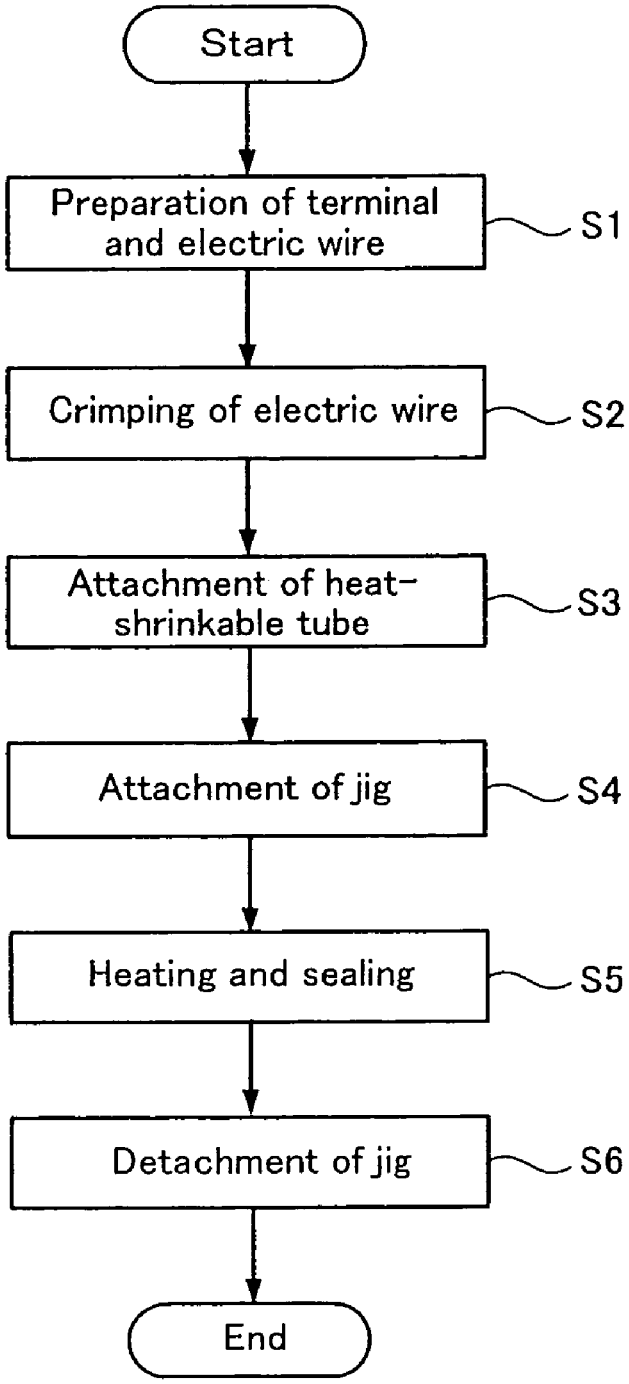
FIG. 7 is a flowchart of a method of making the waterproof lead.

A method of making the first and second waterproof leads 1*a*, 1*b* shown in FIG. 5 will now be described with reference to a flowchart shown in FIG. 7. The method will be described with reference to the first waterproof lead 1*a*, however, it will be appreciated by those skilled in the art that the method of making the second waterproof lead 1*b* is identical thereto and as such will not be described in greater detail herein.

In step S1, the first terminal 10*a* shown in FIG. 1 is fabricated, and the electric wire 20 having the insulative cover 22 is provided. The heat-shrink tube 30 which has not yet been shrunk and which the adhesive 31 has been applied to the internal surface thereof is also provided.

In step S2, the insulative cover 22 at the leading end part of the electric wire 20 is stripped off of the electric wire 20 to expose the core wires 21. The bundle of exposed core wires 21 is fitted into the core wire crimping section 121 and crimped with a core-wire crimper and a core-wire anvil. The leading end part of a remainder of the insulative cover 22 is fitted into the insulative cover crimping section 122 and crimped with an insulating-coating crimper and an insulating-coating anvil.

In step S3, the first terminal 10*a* is connected to the electric wire 20 is covered with the heat-shrink tube 30. The heat-shrink tube 30 covers a sufficient length of the first terminal 10*a* including the insulative cover crimping section 122.

Figure 11:
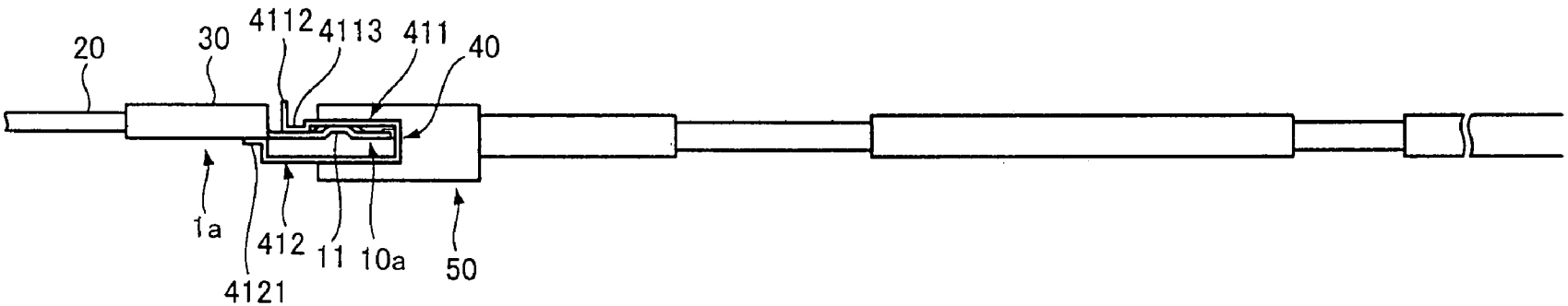
FIG. 11 is a side view of the waterproof lead attached to the jig.

In step S4, the first waterproof lead 1*a* is attached to the jig 40 by inserting it between the paired grip members 41 from a lateral end of the jig 40 (upper side in FIG. 8) and sliding it along the width of the jig 40. As shown in FIG. 11, the jig 40 is attached to the first waterproof lead 1*a* such that the stopper 4112 is disposed between the leading end of the core wires 21 and the contact member 11 of the first terminal 10*a*. When the jig 40 is attached to the first terminal 10*a*, the recess 4113 comes into contact with a portion of the contact member 11 of the first terminal 10*a* that is closer to the wire attachment member 12 than the insertion opening 111.

The end of the heat-shrink tube 30, which covers the leading end of the core wires 21, is mounted on the portion of the substantially L-shaped tube pressing section 4121, which is bent toward the front of the jig 40, and the tube pressing section 4121 presses the heat-shrink tube 30 against the upper grip member 411 by the resilience of the pair of arm sections 4123. The jig 40 holds the first terminal 10*a* between the upper grip member 411 and the lower grip member 412.

In step S5, once the attachment of the jig 40 is completed, the heat-shrink tube 30 is heated with hot air thereby sealing, with the adhesive 31, the clearances S between the adjacent core wires 21. When the heat-shrink tube 30 is heated, the heat-shrink tube 30 shrinks in a radial direction and the adhesive 31 applied to the internal surface of the heat-shrink tube 30 is melted. The melted adhesive 31 flows out of the ends of the heat-shrink tube 30. The adhesive 31 that flows out of the ends of the heat-shrink tube 30 covers the leading end of the core wires 21 and is stopped by the stopper 4112 of the jig 40. The stopped adhesive 31 flows back into the clearances S between the adjacent core wires 21 at the leading end of the core wires 21.

When the temperature of the adhesive 31 drops to room temperature, the adhesive 31 is set in the clearances S to seal the clearances S. Thus, the adhesive 31 does not flow to the contact member 11 located forward of the stopper 4112, and the adhesive 31 is thereby prevented from coming into contact with the contact member 11. Accordingly, the first waterproof lead 1*a* manufactured using the jig 40 can provide a reliable electrical connection. In addition, the jig 40 used in making the first waterproof lead 1*a* eliminates the need for preparing a terminal specially configured for the purpose of waterproofing or for preventing the adhesive 31 from contacting the contact member 11. Because a terminal having an ordinary configuration can be used, a variety of terminals do not need to be produced.

If the molten adhesive 31 functions as a lubricant and the heat-shrink tube 30 moves or the heat-shrink tube 30 shrinks along its length, there is a possibility that the heat-shrink tube 30 may move away from the leading end of the core wires 21 and the molten adhesive 31 will not reach the stopper 4112. In the state shown in FIG. 11, however, since the end part of the heat-shrink tube 30, which covers the leading end of the core wires 21, is held by the tube pressing section 4121, the heat-shrink tube 30 is prevented from moving and/or shrinking so that the molten adhesive 31 reliably reaches the stopper 4112.

In step S6, the jig 40 is detached from the first waterproof lead 1*a*, and the first waterproof lead 1*a* is completed. When detaching the jig 40 from the first waterproof lead 1*a*, the adhesive 31 that flowed out of the heat-shrink tube 30 and has been set remains on the surface of the stopper 4112 facing the heat-shrink tube 30. The adhesive 31 that flows back toward the heat-shrink tube 30 after being stopped by the stopper 4112 is either remains on the surface of the tube pressing section 4121 on which the heat-shrink tube 30 is mounted, or drips from the surface along the adjacent surface bent approximately 90 degrees toward the upper grip member 411. However, since these surfaces of the jig 40 are provided with the coatings 4112*a*, 4121*a* of tetrafluoroethylene resin, the adhesive 31 does not stick to the surfaces and the first waterproof lead 1*a* can easily be detached from the jig 40. Although the coatings 4112*a*, 4121*a* of tetrafluoroethylene resin are described as being provided on only a portion of the stopper 4112 and the tube pressing section 4121 in the above description, the coatings 4112*a*, 4121*a* may alternatively be formed on the entire surface of the stopper 4112 and/or tube pressing section 4121, or a single coating may be formed over the entire jig 40.

The method of making the first waterproof lead 1*a* sufficiently waterproofs the first waterproof lead 1*a* by simply heating the heat-shrink tube 30. Because no soldering steps are required, the manufacturing cost of the first waterproof lead 1*a* can be greatly reduced. In step S5, the adhesive 31 is made to flow into the clearances S between the adjacent core wires 21 at the leading end of the core wires 21 to seal the clearances S. However, even if the adhesive 31 cannot flow into the clearances S of the core wires 21 and can only cover the end surface of the core wires 21, the waterproofing effect is as effective or better than that of the conventional waterproof leads. In addition, the method of making the first and second waterproof leads 1*a*, 1*b* can be applied to a case where the first and second terminals 1*a*, 1*b* are mated with each other, as shown in FIG. 5.

I claim:

1. A method for making a waterproof lead, comprising the steps of:

stripping a portion of an insulative cover from an electric wire to expose a plurality of core wires;

crimping the plurality of core wires with a core wire crimping section of a terminal;

crimping the insulative cover with a cover crimping section of the terminal;

covering at least a leading end of the plurality of core wires adjacent to the core wire crimping section after crimping with a heat-shrink tube that has an adhesive provided on an internal surface thereof; and melting the adhesive to seal clearances between adjacent core wires with the adhesive.

2. The method of claim 1, wherein the heat-shrink tube covers the core wire crimping section.

3. The method of claim 2, wherein the heat-shrink tube covers the insulative cover crimping section.

4. The method of claim 1, further comprising setting the adhesive at ends of the heat-shrink tube.

5. The method of claim 1, wherein the insulative cover crimping section crimps an end of the insulative cover.

6. The method of claim 1, wherein the leading end of the exposed core wires is adjacent a contact member of the terminal.

7. The method of claim 1, further comprising attaching a jig having a stopper to the terminal after covering the plurality of core wires with the heat-shrink tube such that the stopper is disposed between a leading end of the plurality of core wires and a contact member of the terminal.

8. A jig for making a waterproof lead that has a terminal, an electric wire, and a heat-shrink tube covering at least a leading end of exposed core wires of the electric wire, the jig comprising:

upper and lower grip members configured for receiving the waterproof lead therebetween, the upper grip member having a stopper extending therefrom configured for positioning between the leading ends of the exposed core wires and a contact member of the terminal, the stopper being configured for preventing an adhesive on the internal surface of the heat-shrink tube from reaching the contact member, and the lower grip member including a tube pressing section resiliently biased toward the upper grip member.

9. The jig of claim 8, wherein the stopper has a coating of tetrafluoroethylene resin.

10. The jig of claim 8, wherein the stopper is formed on a free end of the upper grip member.

11. The jig of claim 8, wherein the stopper is approximately perpendicular to the upper grip member.

12. The jig of claim 8, wherein the tube pressing section has a coating of tetrafluoroethylene resin.

13. The jig of claim 8, wherein the tube pressing section is formed on a free end of the lower grip member.

14. The jig of claim 8, wherein the lower grip member includes arm sections and lateral ends of the tube pressing section are connected to the arm sections.

15. The jig of claim 8, wherein the tube pressing section is offset in a direction of length of the jig from the stopper.

16. The jig of claim 15, wherein the tube pressing section and the stopper extend along a direction of width of the jig.

17. The jig of claim 8, wherein the jig is formed from a single metal plate.

18. The jig of claim 17, wherein the jig is fixed in a holder.

19. The jig of claim 8, wherein the upper and lower grip member are connected.

* * * * *

UNITED STATES PATENT AND TRADEMARK OFFICE

CERTIFICATE OF CORRECTION

PATENT NO. : 7,294,008 B2
APPLICATION NO. : 10/972137
DATED : November 13, 2007
INVENTOR(S) : Shozo Fukuyama It is certified that error appears in the above-identified patent and that said Letters Patent is hereby corrected as shown below:

On the Title Page, (56) Reference Cited, U. S. Patent Documents, add

-- 2002/0027013 A1 3/2002 Kondo . . . . . .439/110 R --

Signed and Sealed this

Twenty-fifth Day of November, 2008

JON W. DUDAS
*Director of the United States Patent and Trademark Office*